US012655763B2

(12) United States Patent
Addy

(10) Patent No.: US 12,655,763 B2
(45) Date of Patent: Jun. 16, 2026

(54) ROTARY ENGINE LUBRICATION SYSTEM

(71) Applicant: Compound Rotary Engines Limited, Lichfield (GB)

(72) Inventor: Shaun Addy, Lichfield (GB)

(73) Assignee: Compound Rotary Engines Limited, Lichfield (GB)

( * ) Notice: Subject to any disclaimer, the term of this patent is extended or adjusted under 35 U.S.C. 154(b) by 0 days.

(21) Appl. No.: 18/863,749

(22) PCT Filed: May 9, 2023

(86) PCT No.: PCT/GB2023/051213
§ 371 (c)(1),
(2) Date: Nov. 7, 2024

(87) PCT Pub. No.: WO2023/218178
PCT Pub. Date: Nov. 16, 2023

(65) Prior Publication Data

US 2025/0277452 A1 Sep. 4, 2025

(30) Foreign Application Priority Data

May 10, 2022 (GB) ..... 2206798

(51) Int. Cl.
*F01C 21/04* (2006.01)
*F01C 1/22* (2006.01)

(52) U.S. Cl.
CPC ..... *F01C 21/04* (2013.01); *F01C 1/22* (2013.01); *F04C 2240/60* (2013.01)

(58) Field of Classification Search
CPC ..... F01C 21/04; F01C 1/22; F02B 2053/005
See application file for complete search history.

(56) References Cited

U.S. PATENT DOCUMENTS

| | | | | |
|---|---|---|---|---|
| 3,771,903 A | | 11/1973 | King | |
| 3,782,869 A | | 1/1974 | Steinwart | |
| 3,784,337 A | | 1/1974 | Sebring | |
| 4,940,400 A | * | 7/1990 | Speiser | F16N 7/36 418/104 |
| 4,969,809 A | * | 11/1990 | Eiermann | F01C 21/04 418/91 |

(Continued)

FOREIGN PATENT DOCUMENTS

| | | | | |
|---|---|---|---|---|
| DE | 3320086 A1 | | 12/1984 | |
| EP | 0292933 A2 | * | 11/1988 | F01C 21/04 |

(Continued)

*Primary Examiner* — Ngoc T Nguyen
(74) *Attorney, Agent, or Firm* — Sisson & Banyas, Attorneys at Law LLC; Jeffrey J. Banyas

(57) ABSTRACT

A rotary piston internal combustion engine includes an engine housing, an output shaft configured to rotate relative to the engine housing about an axis for transmitting power to parts to be operated, a rotary piston mounted eccentrically on the output shaft, a first bearing configured to support and facilitate rotation of the output shaft, the first bearing being sandwiched between a first pair of seals and a second bearing configured to support and facilitate rotation of the rotary piston, the second bearing being sandwiched between a second pair of seals, wherein the output shaft defines an internal path which has a first section to allow a lubricating substance to flow between the first bearing and the second bearing, in use.

19 Claims, 13 Drawing Sheets

(56) References Cited

U.S. PATENT DOCUMENTS

| | | | |
|---|---|---|---|
| 5,199,863 | A | 4/1993 | Eiermann |
| 5,305,721 | A | 4/1994 | Burtis |

FOREIGN PATENT DOCUMENTS

| | | | |
|---|---|---|---|
| EP | 2789852 | A2 | 10/2014 |
| FR | 1536800 | A | 8/1968 |
| WO | 2006067843 | A1 | 6/2006 |

* cited by examiner

ROTARY ENGINE LUBRICATION SYSTEM

PRIORITIES AND CROSS REFERENCES

This Application claims priority from International Application No. PCT/GB2023/051213 filed on 9 May 2023 and United Kingdom Application No. 2206798.7 filed on 10 May 2022, the teachings of each of which are incorporated by reference herein in its entirety.

FIELD OF THE INVENTION

The present invention relates to rotary piston internal combustion engines. More particularly, the invention relates to rotary piston internal combustion engines having a configuration which provides for improved lubrication efficiency of internal bearings and sliding surfaces.

BACKGROUND

It is known that rotary piston internal combustion engines, such as the Wankel engine, include an oval-like epitrochoidal cavity formed within the engine housing, a rotary piston and an output shaft. The rotary piston has a substantially triangular shape with convex arcuate flanks. Apex seals are located at the three apices of the rotary piston. During operation, the apex seals maintain physical contact with an inner peripheral surface of the cavity, thereby forming three combustion chambers. The cavity is provided with inlet and exhaust ports, the inlet port supplying a fuel and/or air charge to the cavity and the exhaust port venting exhaust gases to atmosphere after combustion has occurred in the combustion chambers. Combustion of the fuel causes expansion of combustion gases resulting in increased pressure in the combustion chambers, thereby resulting in rotation of the rotary piston relative to the engine housing. For every rotation of the rotary piston there are three rotations of the output shaft. A lubricating substance, such as oil, can be introduced to the engine to prevent overheating and seizing by lubricating the moving parts (e.g. bearings and seals), thus extending the lifetime of the engine.

One known method of lubricating moving parts of a rotary engine can be found in EP2240671, which discloses a metering pump that supplies oil to a cooling circuit. The oil is carried by the circulating cooling or combustion gas to lubricate various components, such as bearings, gears, and the internal sliding surfaces of the rotary piston. A proportion of oil then passes out of the rotary piston, through external ducting, through a cooling heat exchanger and pump to be returned to the rotary piston. Circulating oil can also enter the combustion chambers of the engine as part of an air induction charge. Consequently, all oil pumped into this type of engine is ultimately burnt and exhausted to the atmosphere.

A disadvantage of the lubricating system described in EP2240671 is that a large amount of oil introduced to the engine is consumed. For example, the 225CS™ (which is a 40 BHP rotary engine manufactured by Advanced Innovative Engineering of Lichfield in the UK which has a lubricating system taught by EP2240671) consumes oil at a rate of approximately 150 cc/hr. In this engine oil distribution is indiscriminate and dependent on engine dynamics and system pressures. Consequently, oil reaches components that do not require lubrication. Therefore, a large volume of lubricating substance is needed to ensure all the moving components of the engine are sufficiently lubricated. Furthermore, the oil can become entrained with impurities, e.g., carbon build up from the sliding surfaces of the rotary piston, which means that impure oil can be transferred to other component parts such as the bearings due to the fact that some of the oil can recirculate.

Vehicles or devices comprising such engines can have high hydrocarbon emissions due to the amount of oil that is burnt. This means that owners of such vehicles may be subjected to charges, e.g. clean air charges, in countries that have strict policies on vehicle emissions. Due to global warming, more stringent restrictions may be adopted by many countries, which may lead to vehicles having high carbon emissions being prohibited in some countries. Moreover, maintenance costs are not insignificant since a large amount of oil is required to keep these engines healthy. Furthermore, a large capacity oil reservoir may be needed to store the required oil which is not ideal.

It is a non-exclusive object of the present invention to overcome or at least substantially alleviate one or more of the problems associated with the prior art and/or mentioned above.

One objective is to maintain lubrication performance whilst reducing oil consumption.

SUMMARY OF INVENTION

According to a first aspect of the invention, there is provided a rotary piston internal combustion engine including:

- an engine housing;
- an output shaft configured to rotate relative to the engine housing about an axis for transmitting power to parts to be operated;
- a rotary piston mounted eccentrically on the output shaft;
- a first bearing configured to support and facilitate rotation of the output shaft, the first bearing being sandwiched between a first pair of seals; and
- a second bearing configured to support and facilitate rotation of the rotary piston, the second bearing being sandwiched between a second pair of seals;
- wherein the output shaft defines an internal path comprising a first section to allow a lubricating substance (e.g. oil) to flow between the first bearing and the second bearing, in use.

The rotary piston internal combustion engine may be configured so that the lubricating substance flows from the first bearing to the second bearing.

Optionally, the internal path comprises a second section to allow the lubricating substance to flow between the second bearing and a third bearing, in use.

The rotary piston internal combustion engine may be configured so that the lubricating substance flows from the second bearing to the third bearing.

Optionally, the output shaft defines a bore which at least partially extends along the axis. The rotary piston internal combustion engine may further comprise a first barrier member. The first barrier member may be located in the bore between the first section and the second section. The first barrier member may be configured to direct the flow of the lubricating substance from the first section to the second bearing.

Optionally, the first barrier member is configured to prevent the flow of the lubricating substance along the bore and past the first barrier member.

Optionally, the rotary piston internal combustion engine further comprises a second barrier member. The second barrier member may be located in the bore and be configured to direct the flow of the lubricating substance from the second section to the third bearing.

Optionally, the second barrier member is configured to prevent the flow of the lubricating substance along the bore and past the second barrier member.

Optionally, the rotary piston internal combustion engine further comprises a rod located within the bore.

Optionally, the rod comprises one or both of the first barrier member and the second barrier member.

Optionally, the rod is biased towards the first bearing. The rod may be biased by a resilient member, such as a spring, e.g. a coil spring. The resilient member may be located within the bore.

Optionally, the third bearing is configured to support and facilitate rotation of the output shaft.

Optionally, the third bearing is in fluid communication with a thrust bearing.

Optionally, the third bearing and the thrust bearing are configured so that, in use, the lubricating substance is received by the thrust bearing from the third bearing along a direction that is parallel to the axis.

Optionally, the thrust bearing comprises a first side and a second side, the second side being spaced apart from the first side along the axis, wherein the first side includes an inlet for receiving the lubricating substance from the third bearing and the second side includes an outlet for the lubricating substance to exit the thrust bearing.

Optionally, the third bearing is sandwiched between the thrust bearing and a third seal.

Optionally, the first bearing and/or the third bearing include(s):

a ring;

a retainer located within the ring and mounted coaxially relative thereto; and a rolling element, wherein the rolling element is held relative to the ring by the retainer.

Optionally, the retainer defines an aperture which extends from an outer surface to an inner surface thereof, wherein the aperture receives at least a part of the rolling element.

Optionally, the ring includes an inlet for receiving the lubricating substance.

Optionally, the ring includes a channel which extends around an outer surface thereof, the channel being in fluid communication with the inlet.

Optionally, the inlet is formed in the channel.

Optionally, the first and/or the second pair of seals include (s) one or more seals configured to withstand fluid pressures of 300 kPa and above. For example, the seals are configured to withstand fluid pressures of 300 kPa to 10,000 kPa, such as 300 kPa to 1,000 kPa, e.g. 300 kPa to 500 kPa.

In one embodiment, the first pair of seals includes a first seal configured to withstand fluid pressures of 300 kPa and above (such as 300 kPa to 10,000 kPa, such as 300 kPa to 1,000 kPa, e.g. 300 kPa to 500 kPa) and a second seal configured to withstand fluid pressures of up to 299 kPa (such as 50 kPa to 299 kPa).

In one embodiment, the second pair of seals includes first and second seals configured to withstand fluid pressures of up to 299 kPa (such as 50 kPa to 299 kPa).

Optionally, the second bearing comprises or consists solely of a ring fixed relative to an inner periphery of the rotary piston.

Optionally, the rotary piston internal combustion engine further comprises a lubricating substance reservoir and a pump. The pump may be configured to pump the lubricating substance from the lubricating substance reservoir to the first bearing.

Optionally, the rotary piston internal combustion engine further comprises a rotor cooling system cavity and a lubricating substance reservoir, wherein in use, the lubricating substance reservoir is pressurised by blow-by gases in the rotor cooling system cavity such that the lubricating substance flows to the first bearing from the lubricating substance reservoir.

Optionally, the lubricating substance reservoir is located internally or externally of the engine housing.

Optionally, the rotary piston has a substantially triangular shape with three apex seals. An inner peripheral surface of the engine housing may have a two lobed epitrochoidal shape. In use, the apex seals may maintain physical contact with the inner peripheral surface.

According to a second aspect of the invention, there is provided a vehicle or a device comprising a rotary piston internal combustion engine according to the first aspect of the invention.

The vehicle may be a car, a motorcycle, an aircraft (such as an unmanned aerial vehicle), jet skis or a snowmobile.

The device may be a powertool, such as a chainsaw.

BRIEF DESCRIPTION OF THE DRAWINGS

The present disclosure will now be described, by way of example only, with reference to the accompanying drawings, of which.

DESCRIPTION OF THE INVENTION

Figure 1B:
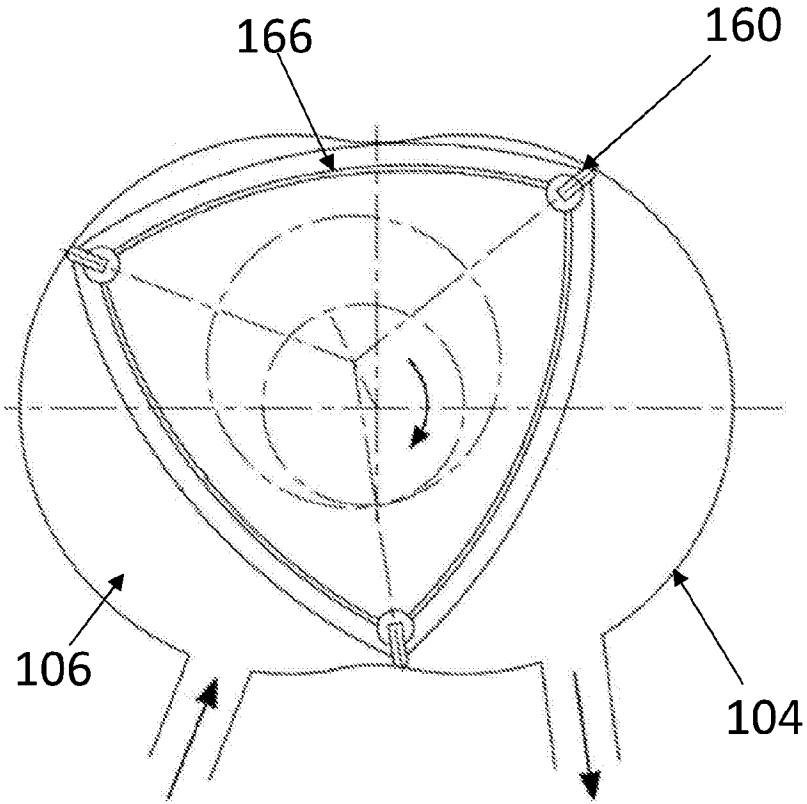
FIGS. 1*a* and 1*b* are cross-sectional views of an engine where a rotary piston is shown at different orientations with respect to the engine housing.
Figure 1A:
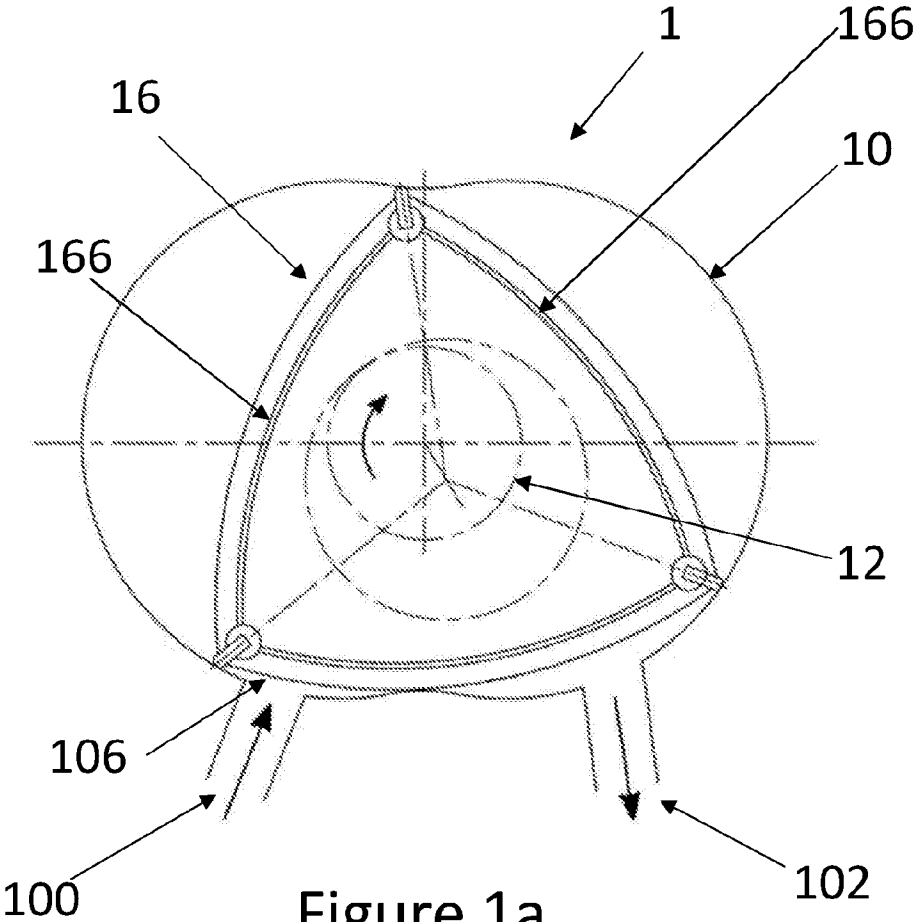

Referring to FIGS. 1*a* and 1*b*, there is shown an engine 1 which includes an engine housing 10 configured to accommodate at least an output shaft 12 and a rotary piston 16. The engine housing 10 defines a cavity having an inner peripheral surface 104. The engine housing 10 may have an inlet port 100 and an exhaust port 102. The inlet port 100 may be configured to supply air and/or fuel charge to the cavity. The exhaust port 102 may be configured to release exhaust gases, for example, to the atmosphere. The internal peripheral surface 104 may have a two lobed epitrochoidal shape. The rotary piston 16 may have a substantially triangular shape. However, it will be appreciated by the skilled person that alternative shapes of the internal peripheral surface 104 (e.g. a three or more lobed epitrochoidal shape) and the rotary piston 16 may be used without departing from the scope of the disclosure. The rotary piston 16 may have apex seals 160 at its apices. There may be one or more apex seals 160 located at each apex of the rotary piston 16. During use, the apex seals 160 may be configured to maintain physical contact with lubricating substance on the internal peripheral surface 104. In some versions, the apex seals 160 may be configured to maintain physical contact with the internal peripheral surface 104. Combustion chambers 106 may be formed between the apex seals 160 and the internal peripheral surface 104. During combustion, gases expand which increases the pressure in the combustion chambers 106. The high-pressure gases move towards higher volume areas causing the rotary piston 16 to be driven relative to the engine housing 10.

Figure 3:
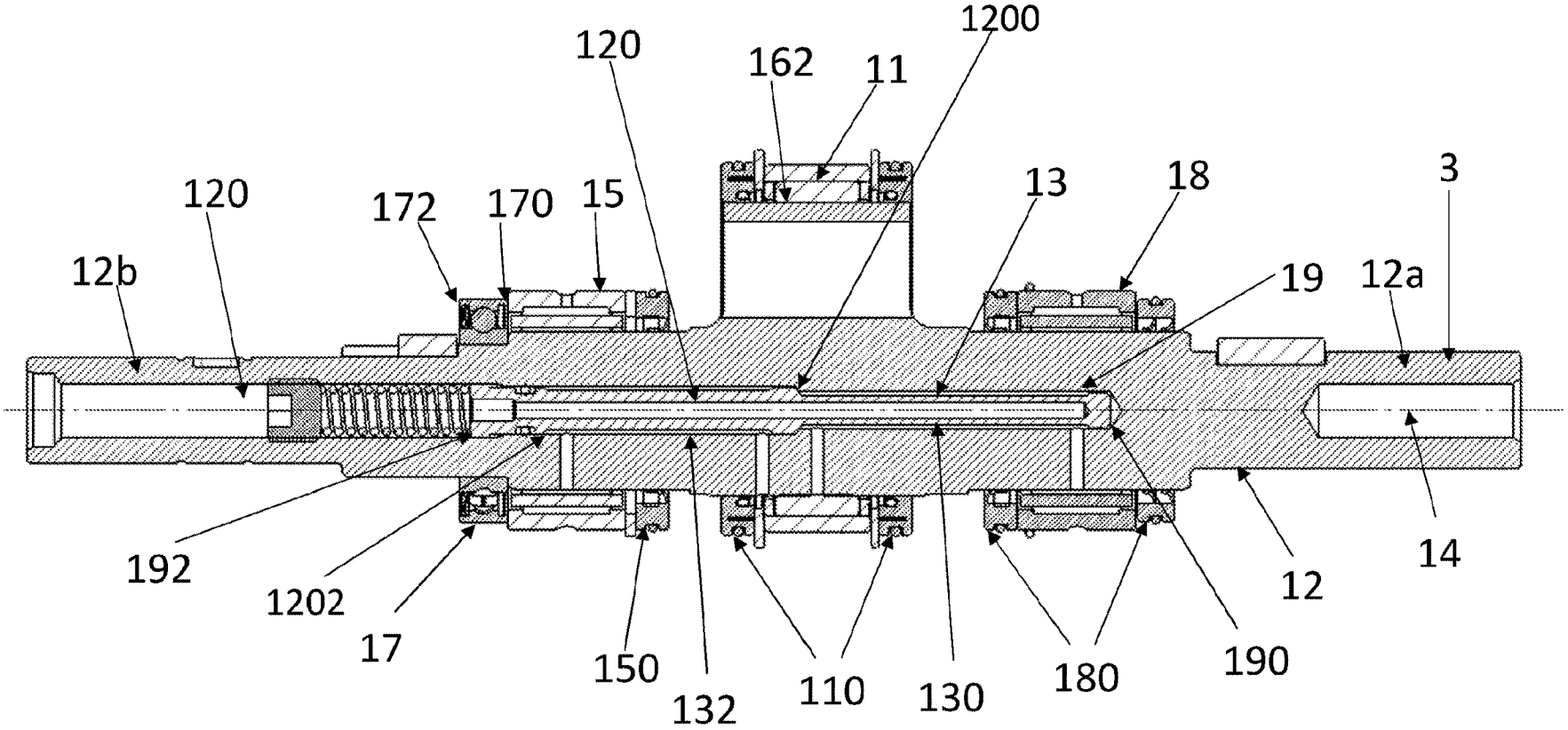
FIG. 3 is a cross-sectional view of a portion of an engine.
Figure 4:
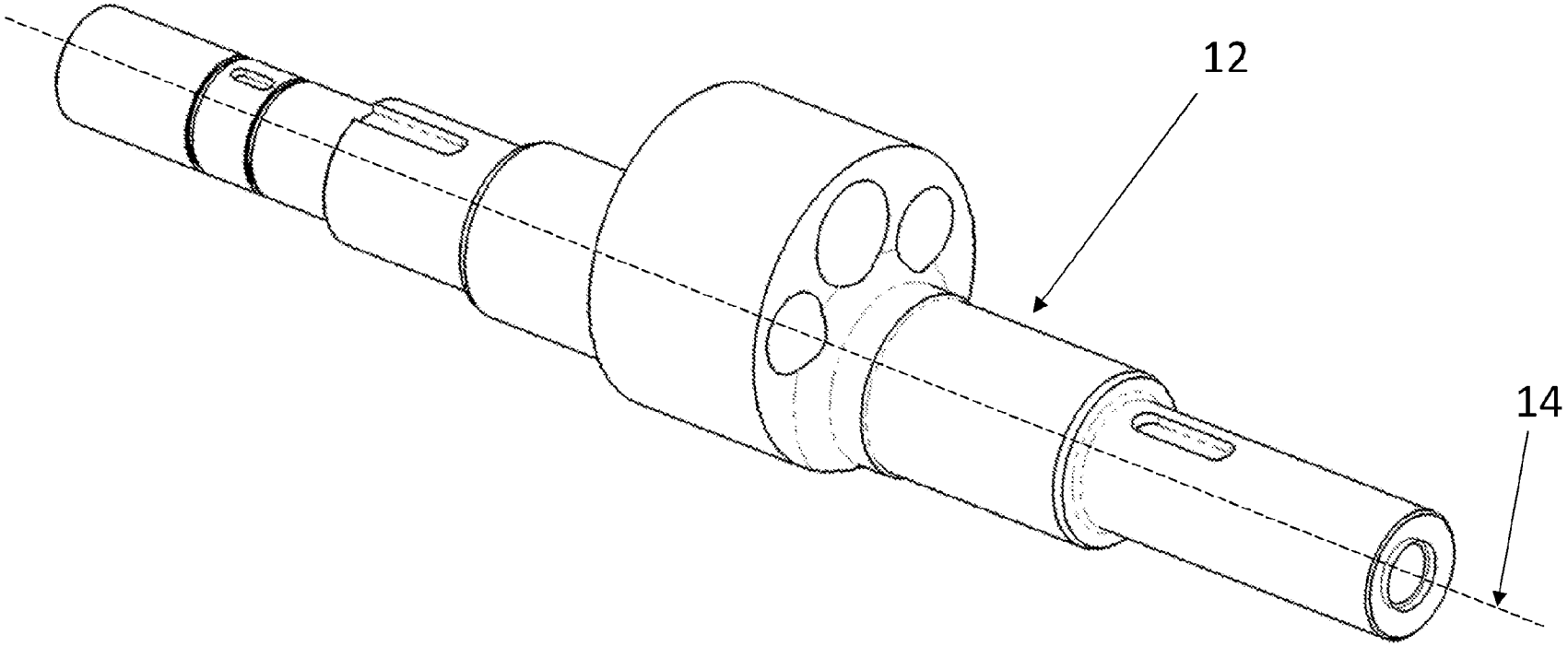
FIG. 4 is a perspective view of an output shaft.
Figure 5:
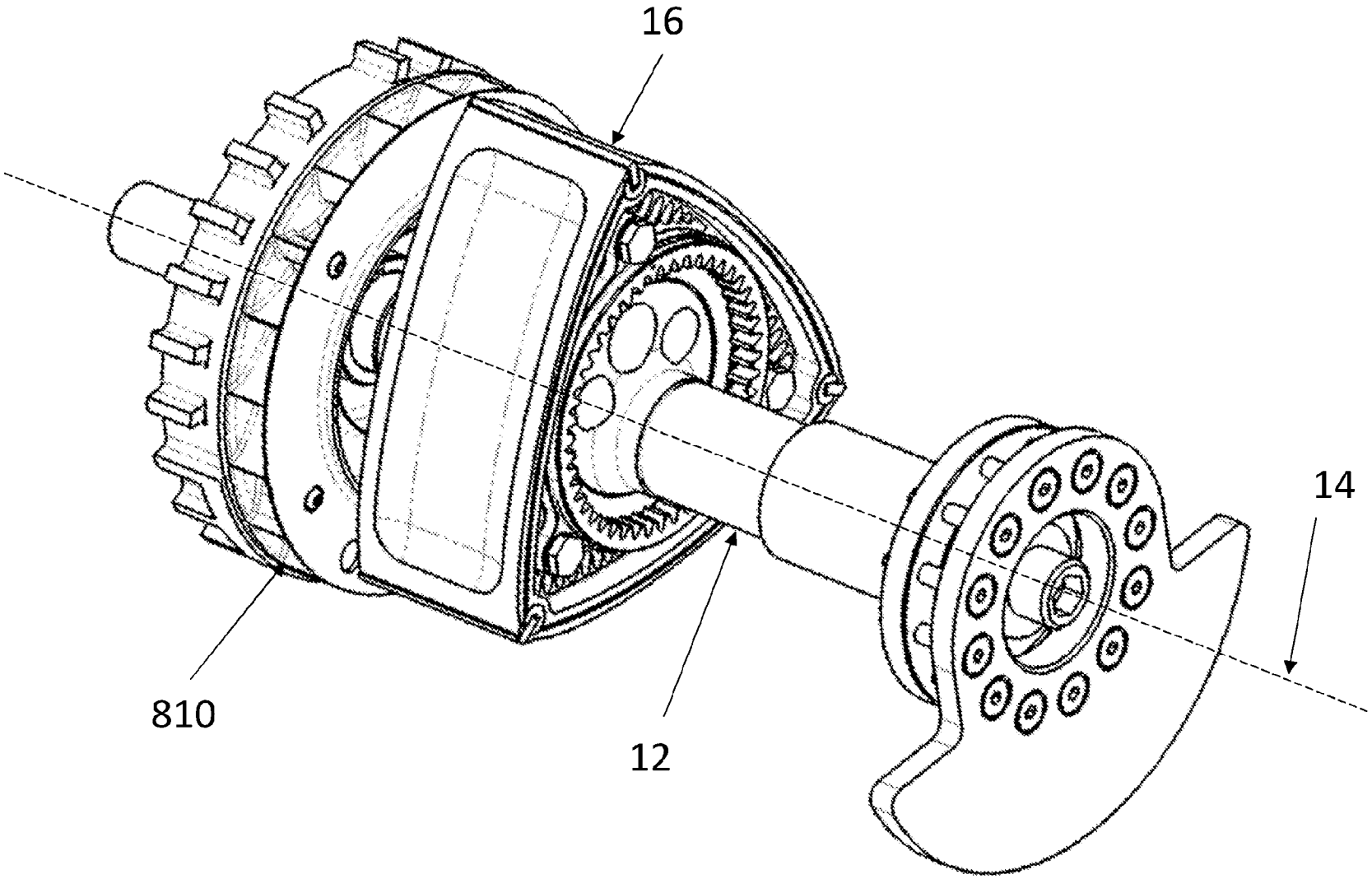
FIG. 5 is a perspective view of a rotary piston mounted on an output shaft.

Referring to FIGS. 3 to 5, the rotary piston 16 is mounted eccentrically on the output shaft 12. As the rotary piston 16 is driven, the output shaft 12 also rotates relative to the engine housing 10 about an axis 14. For every rotation by the rotary piston 16 the output shaft 12 rotates three times. Power can therefore be transmitted to parts to be operated, e.g. a wheel axle or a rotor blade.

A first bearing 18 is configured to support and facilitate rotation of the output shaft 12. In use, the first bearing 18 may be located towards a first end 12*a* of the output shaft 12.

A second bearing 11 is configured to support and facilitate rotation of the rotary piston 16. In some embodiments, the second bearing 11 may consist solely of a ring fixed relative to an inner periphery 162 of the rotary piston 16.

The engine 1 may comprise a third bearing 15 which may be configured to support and facilitate rotation of the output shaft 12. In use, the third bearing 15 may be located towards a second end 12*b* of the output shaft 12, opposite from the first end 12*a*. The rotary piston 16 may be positioned along the axis 14 between the first bearing 18 and the third bearing 15.

Figure 6:
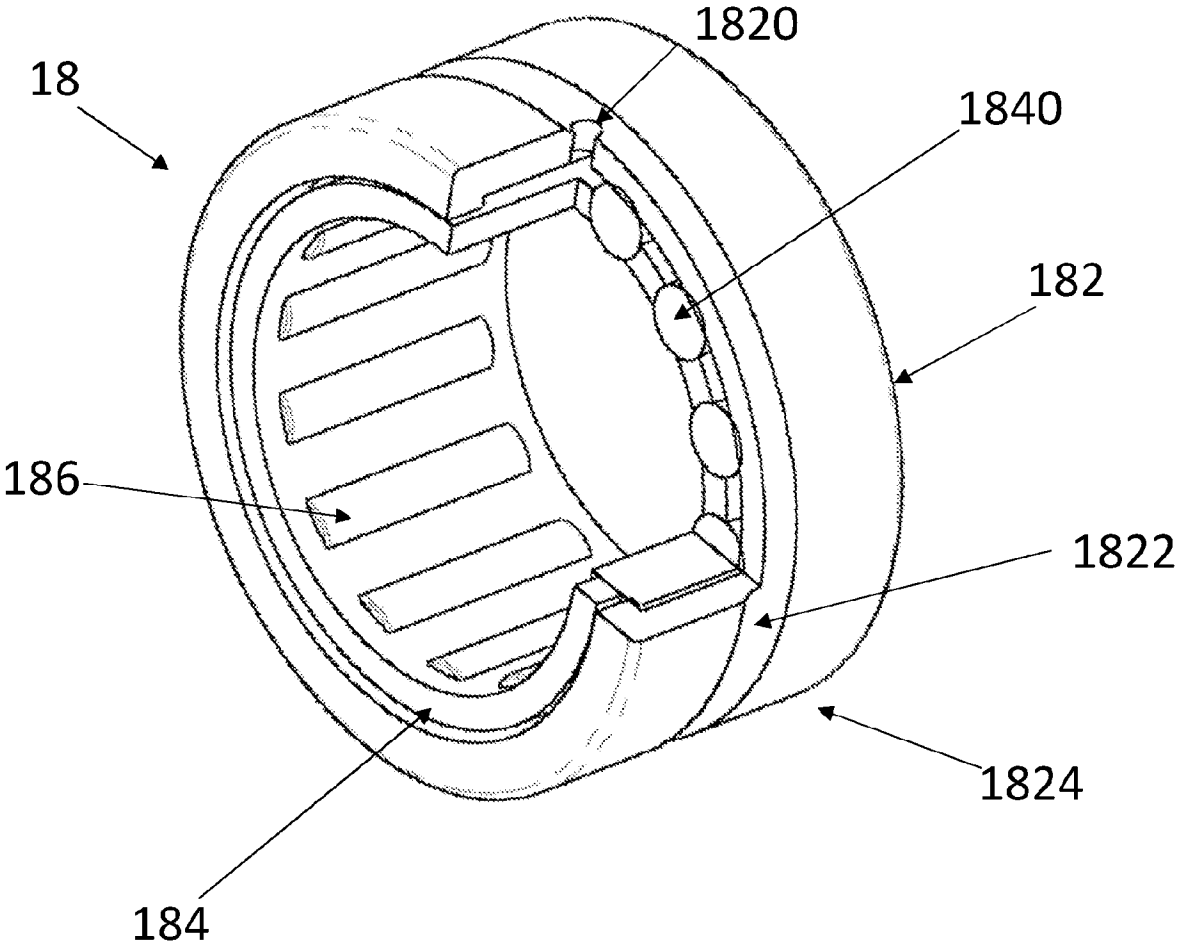
FIG. 6 is a perspective view of a bearing.

Referring to FIG. 6, the first bearing 18 may include a ring 182 and a retainer 184. The retainer 184 may be located within the ring 182 and mounted coaxially relative thereto. A rolling element 186 may be held relative to the ring 182 by the retainer 184. The retainer 184 may define an aperture 1840. The aperture 1840 may extend from an outer surface of the retainer 184 to an inner surface of the retainer 184. The aperture 1840 may be configured to receive at least a part of the rolling element 186. In some embodiments, there may be a plurality of rolling elements 186 and respective apertures 1840. During use, the rolling element(s) 186 may be in physical contact with the output shaft 12. The ring 182 may include an inlet 1820 configured to receive a lubricating substance. The ring 182 may include a channel 1822 which extends around an outer surface thereof. The channel 1822 may be in fluid communication with the inlet 1820. For example, the inlet 1820 may be formed in the channel 1822.

In embodiments comprising a third bearing 15, the third bearing 15 may have the same or a similar configuration as the first bearing 18.

Figure 7:
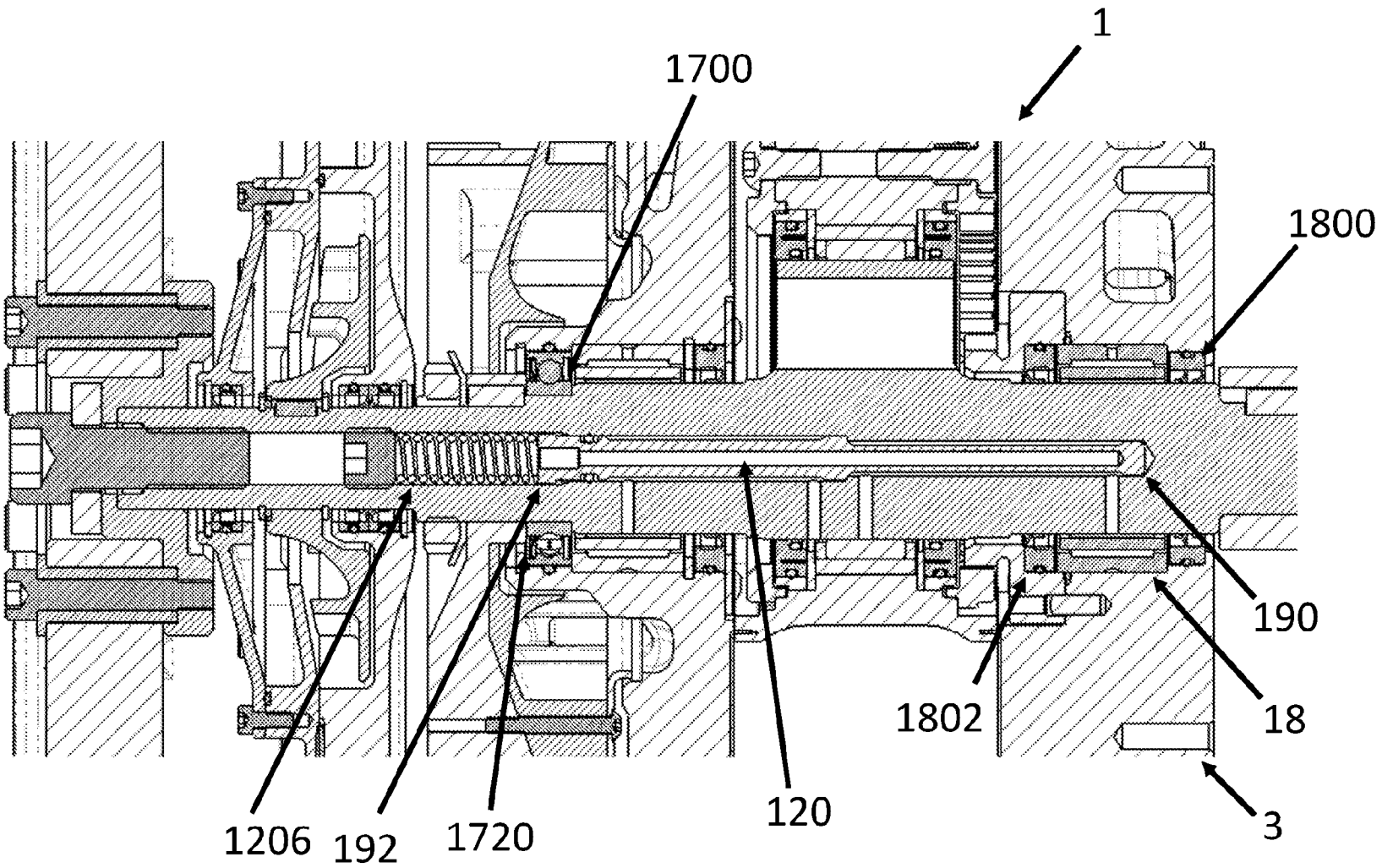
FIG. 7 is a cross-sectional view of a portion of an engine.
Figure 8:
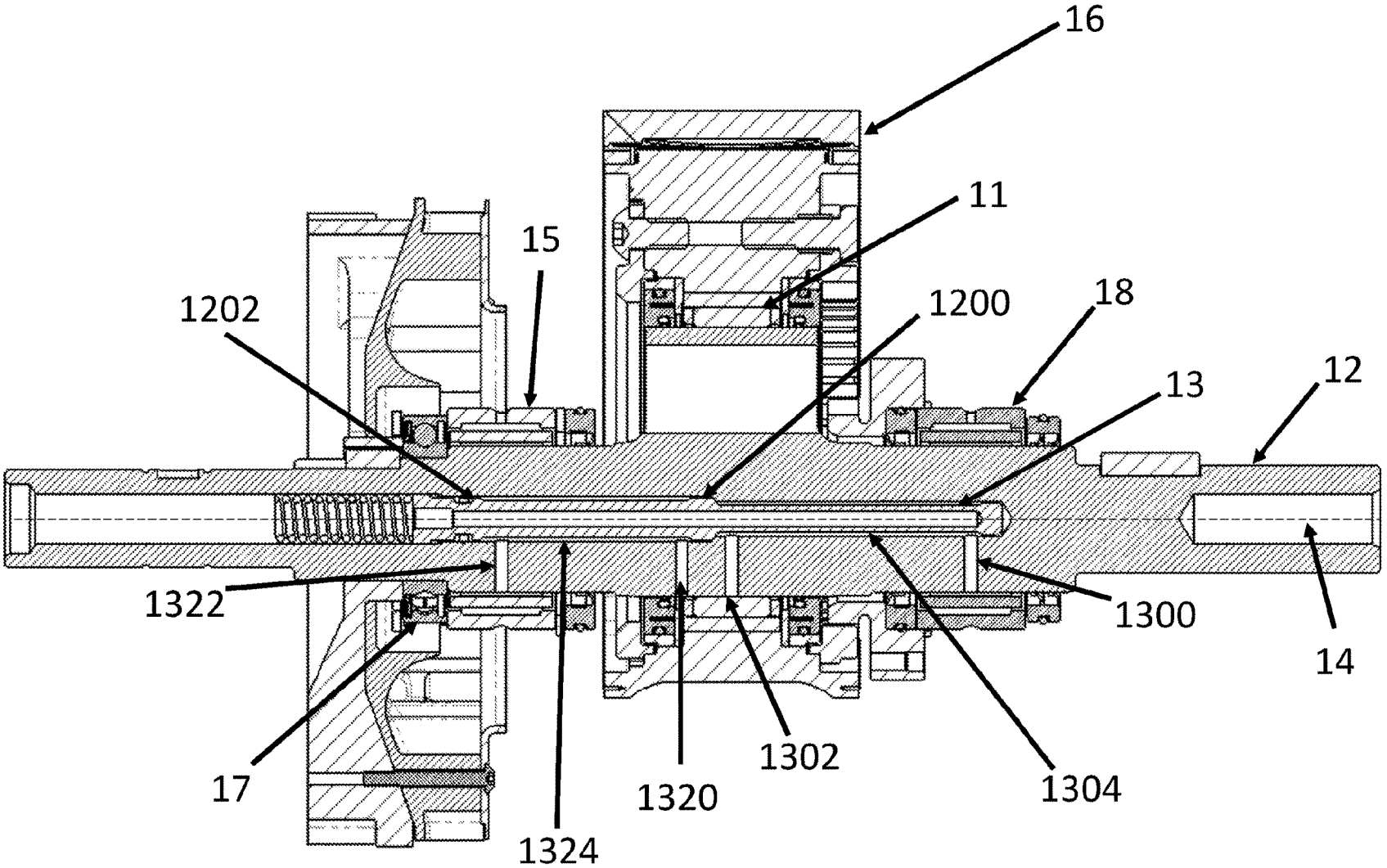
FIG. 8 is a cross-sectional view of a portion of an engine.

Referring back to FIG. 3, the first bearing 18 may be sandwiched between a first pair of seals 180. The first pair of seals 180 may include one or more high pressure seals configured to withstand fluid pressures of 300 kPa and above. The one or more high pressure seals may be configured to withstand fluid pressures of 300 kPa to 10,000 kPa, such as of 300 kPa to 1,000 kPa, e.g. 300 kPa to 500 kPa. For example, the one or more high pressure seals may be multi (e.g. double) lip high fluid pressure seals. The first pair of seals may include one or more low pressure seals configured to withstand fluid pressures of up to 299 kPa. The one or more low pressure seals may be configured to withstand fluid pressures of 50 kPa to 299 kPa. For example, the one or more low pressure seals may be configured to withstand fluid pressures of 100 kPa to 299 kPa. In some embodiments of the disclosure, the first pair of seals 180 may include a high pressure seal 1800 configured to withstand fluid pressures of 300 kPa and above and a low pressure seal 1802 configured to withstand fluid pressures of up to 299 kPa (FIG. 7).

The second bearing 11 may be sandwiched between a second pair of seals 110. The second pair of seals 110 may be low pressure seals configured to withstand fluid pressures of up to 299 kPa.

The third bearing 15 may be sandwiched between a pair of seals. The third bearing 15 may be sandwiched between a third seal 150 and a thrust bearing 17. The third bearing 15 may be in fluid communication with the thrust bearing 17. The third seal 150 may be a low pressure seal configured to withstand fluid pressures of up to 299 kPa.

The thrust bearing 17 may be a conventional rotary bearing, such as a ball bearing. The thrust bearing 17 may include a first side 170 and a second side 172 spaced apart from the first side 170. The thrust bearing 17 may include an inlet 1700 and an outlet 1720 (FIG. 7).

Referring to FIG. 3, the output shaft 12 defines an internal path 13. In use, the lubricating substance may flow from the first bearing 18 to the second bearing 11 along a first section 130 of the internal path 13. The lubricating substance may be able to flow from the second bearing 11 to the third bearing 15 along a second section 132 of the internal path 13.

The output shaft 12 may define a bore 120 which at least partially extends between the first end 12*a* and the second end 12*b* along the axis 14.

In some embodiments, a rod 19 may be located within the bore 120. The rod 19 may be hollow. The rod 19 may be comprised of aluminium. The rod 19 may have a first end 190 and a second end 192.

The rod 19 may comprise a first barrier member 1200. In use, the first barrier member 1200 may be located between the first section 130 and the second section 132. The first barrier member 1200 prevents continued flow of lubricating substance along the bore 120 by redirecting flow from the first section 130 to the second bearing 11. As illustrated, the first barrier member 1200 may comprise a thickening of the rod 19. The first barrier member 1200 may have a conical shape. However, in some embodiments the first barrier member 1200 may take another form, such as a deflector part which extends from the rod 19. In some embodiments, the first barrier member 1200 may not constitute a part of the rod 19. For instance, the first barrier member 1200 may constitute another component of the engine 1, such as an internal wall or part of the output shaft 12.

The rod 19 may comprise a second barrier member 1202. In use, the second barrier member 1202 may be located between the second section 132 and the second end 12*b* of the output shaft 12. The second barrier member 1202 prevents continued flow of lubricating substance along the bore 120 by redirecting flow from the second section 132 to the third bearing 15. As illustrated, the second barrier member 1202 may comprise a thickening of the rod 19. However, in some embodiments the second barrier member 1202 may take another form, such as a deflector part which extends from the rod 19. In some embodiments, the second barrier member 1202 may not constitute a part of the rod 19. For instance, the second barrier member 1202 may constitute another component of the engine 1, such as an internal wall or part of the output shaft 12.

The rod 19 serves two key purposes. First, the rod 19 comprises the first and second barrier members 1200, 1202 which function as diverters to ensure that oil is redirected from the bore 120 to the respective second and third bearings 11, 15. Second, the presence of the rod 19 minimises the volume of oil required to prime the engine. This is because the rod 19 accommodates volume within the bore 120. In versions where the rod 19 is hollow this serves to improve overall weight gains, which can be especially advantageous, e.g. in aerospace applications.

The rod 19 may be biased towards the first end 12*a* of the output shaft 12. The rod 19 may be biased resiliently by a spring 1206 acting on the second end 192 of the rod 19 (FIG. 7). The spring 1206 ensure that the rod 19 remains seated correctly during use. For example, the spring 1206 can account for differing thermal expansion of the output shaft 12 and the rod 19.

Figure 9:
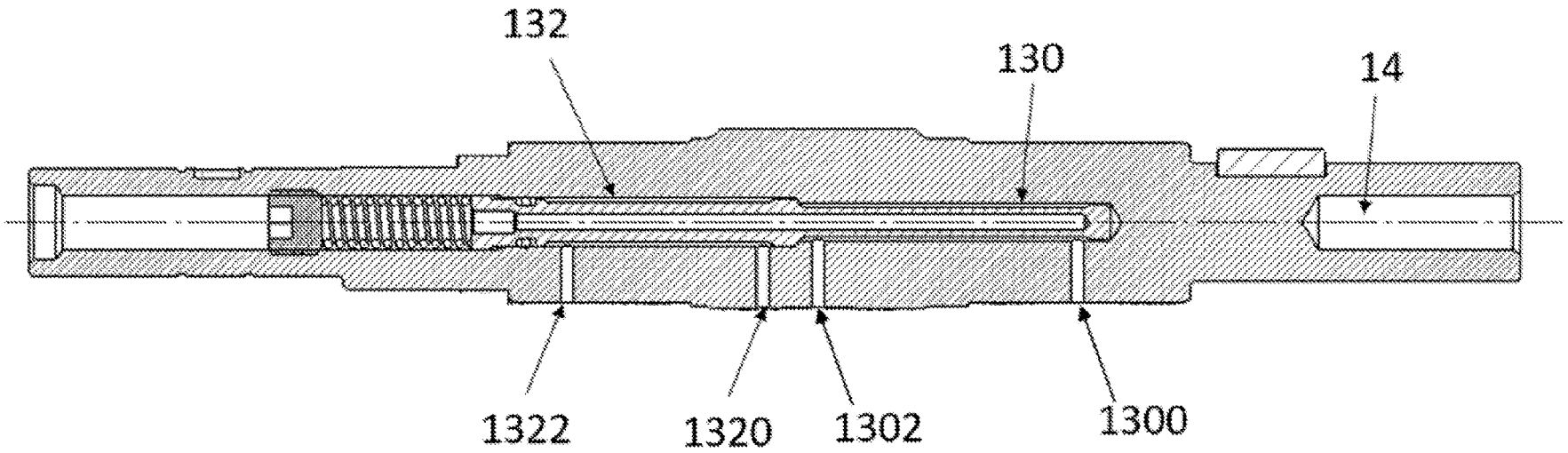
FIG. 9 is a cross-sectional view of an output shaft.

The first section 130 and the second section 132 of the internal path 13 will now be described further with reference to FIG. 9. The first section 130 may include a first part 1300, a second part 1302 and a third part 1304. The second section 132 may include first part 1320, a second part 1322 and a third part 1324.

The first and second parts 1300, 1302; 1320, 1322 of the respective first and second sections 130; 132 may be substantially perpendicular relative to the axis 14. The third parts 1304; 1324 of the respective first and second sections 130; 132 may be substantially parallel relative to the axis 14.

Once a lubricating substance has been delivered to the first bearing 18 (described in more detail below), the lubricating substance can enter the first section 13 via the first part 1300 and flow along the third part 1304 until it is redirected into the second part 1302 by the first barrier member 1200. The lubricating substance then flows into the second bearing 11 before being delivered, sequentially, to the first part 1320 and third part 1324 of the second section 132, until it is redirected into the second part 1322 by the second barrier member 1202. The lubricating substance then flows into the third bearing 15 and exits via the thrust bearing 17.

In versions that do not include the rod 19, the output shaft 12 may comprise two bores (not shown). A first bore may be drilled into the output shaft 12 from the first end 12*a* and a second bore may be drilled into the output shaft 12 from the second end 12*b*. In such versions, the first and second parts 1300, 1302 of the first section 130 may be in fluid communication with the first bore. The first and second parts 1320, 1322 of the second section 132 may also be in fluid communication with the second bore. The first barrier member 1200 may be defined by a section of the output shaft 12 that separates the first bore from the second bore.

Figure 10B:
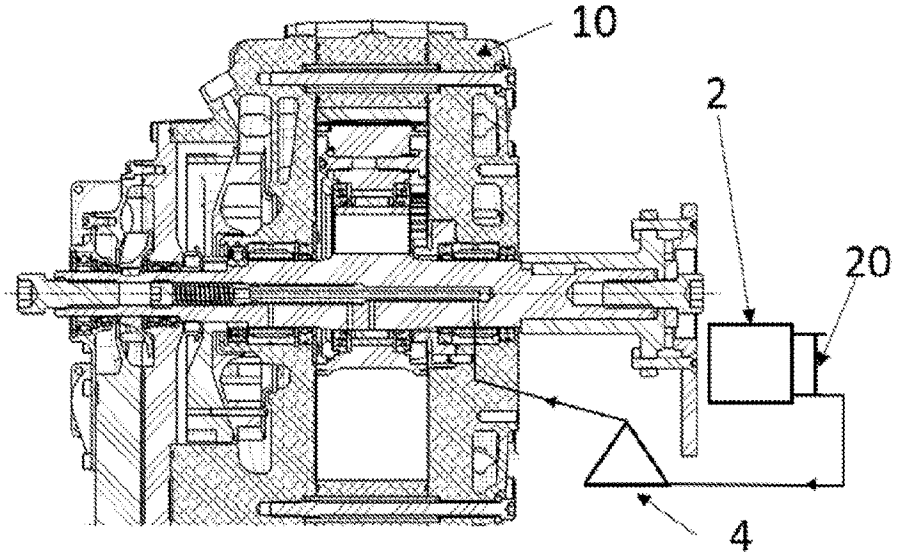
FIGS. 10*a* and 10*b* are cross-sectional views of first and second embodiments of the disclosure.
Figure 10A:
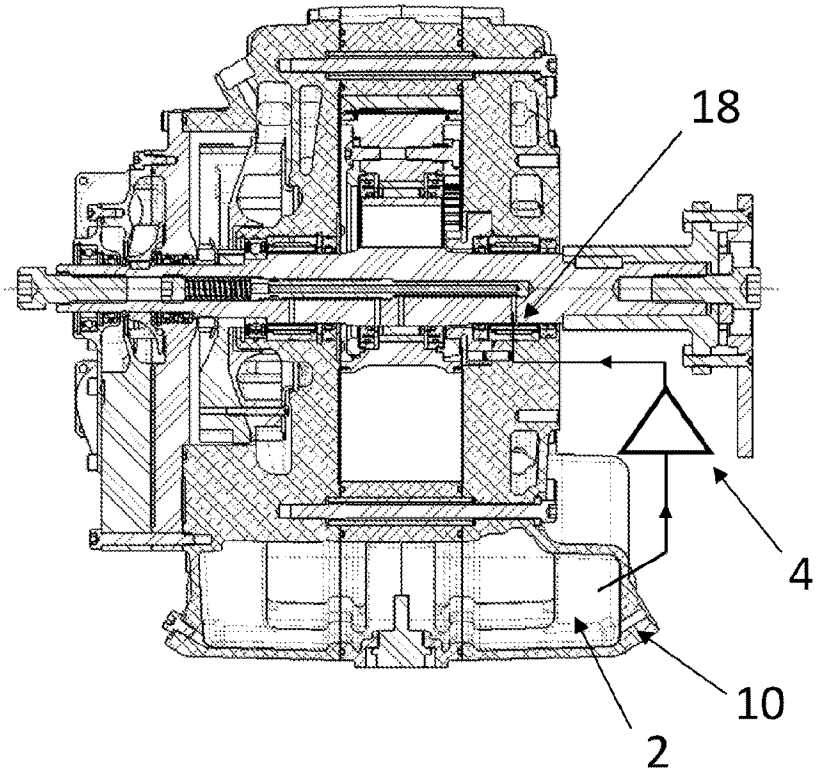

Referring to FIGS. 10*a* and 10*b*, the engine 1 may further comprise a lubricating substance reservoir 2 and a pump 4. The lubricating substance reservoir 2 may be located internally (FIG. 10*a*) or externally (FIG. 10*b*) of the engine housing 10. Referring to FIG. 10*b*, the lubricating substance reservoir 2 may have a calibrated sight glass 20 configured to allow a user to determine a lubricating substance level. The pump 4 may be configured to pump the lubricating substance from the lubricating substance reservoir 2 to the first bearing 18. In some embodiments of the disclosure, the pump 4 may be controlled by an Engine Control Unit (ECU). The ECU may be configured to receive relevant information from sensors located in the engine 1. The sensors may include temperature, pressure, level and/or flowrate sensors. Alternatively, the pump 4 may be manually controlled.

Figure 11:
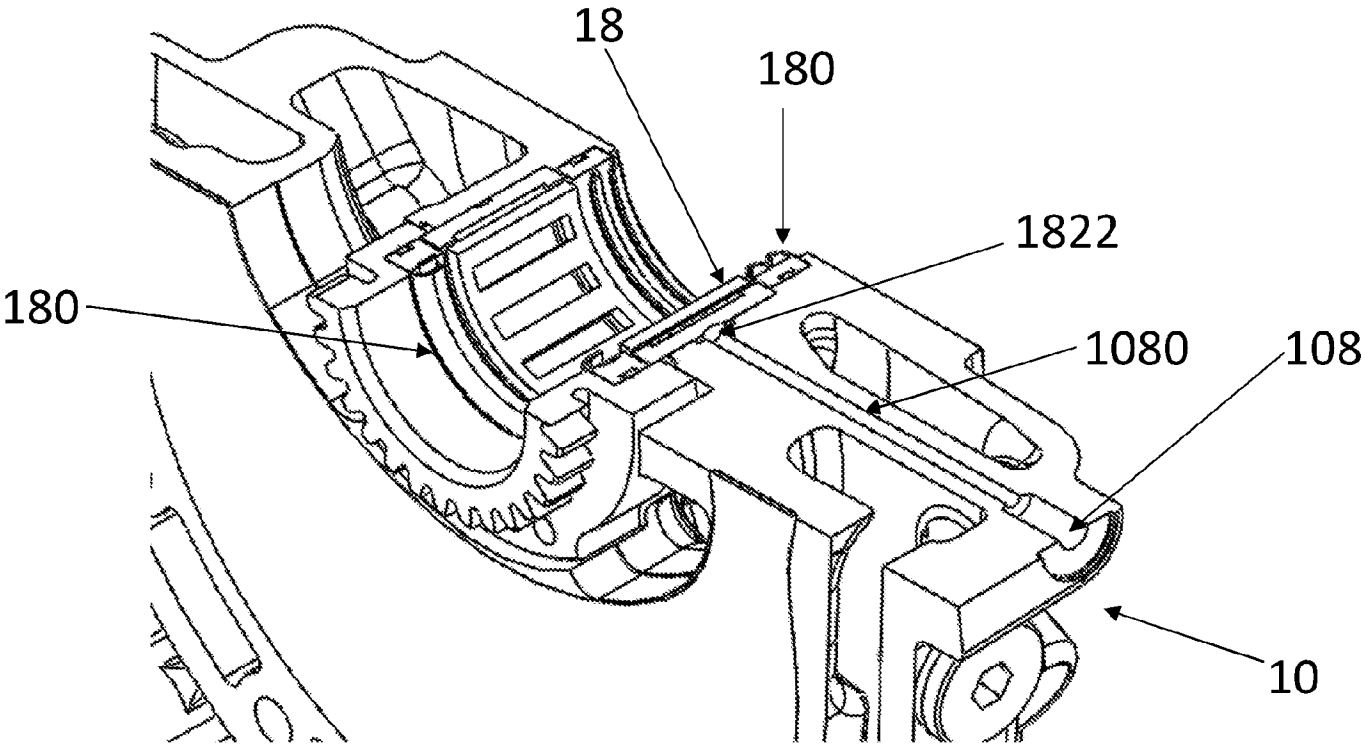
FIG. 11 is a cross-sectional view of part of an engine showing a bearing.

Referring to FIG. 11, the lubricating substance may be supplied to the first bearing 18 via an inlet 108 and supply channel 1080. The supply channel 1080 may supply the lubricating substance to the channel 1822 of the first bearing 18.

Figure 12:
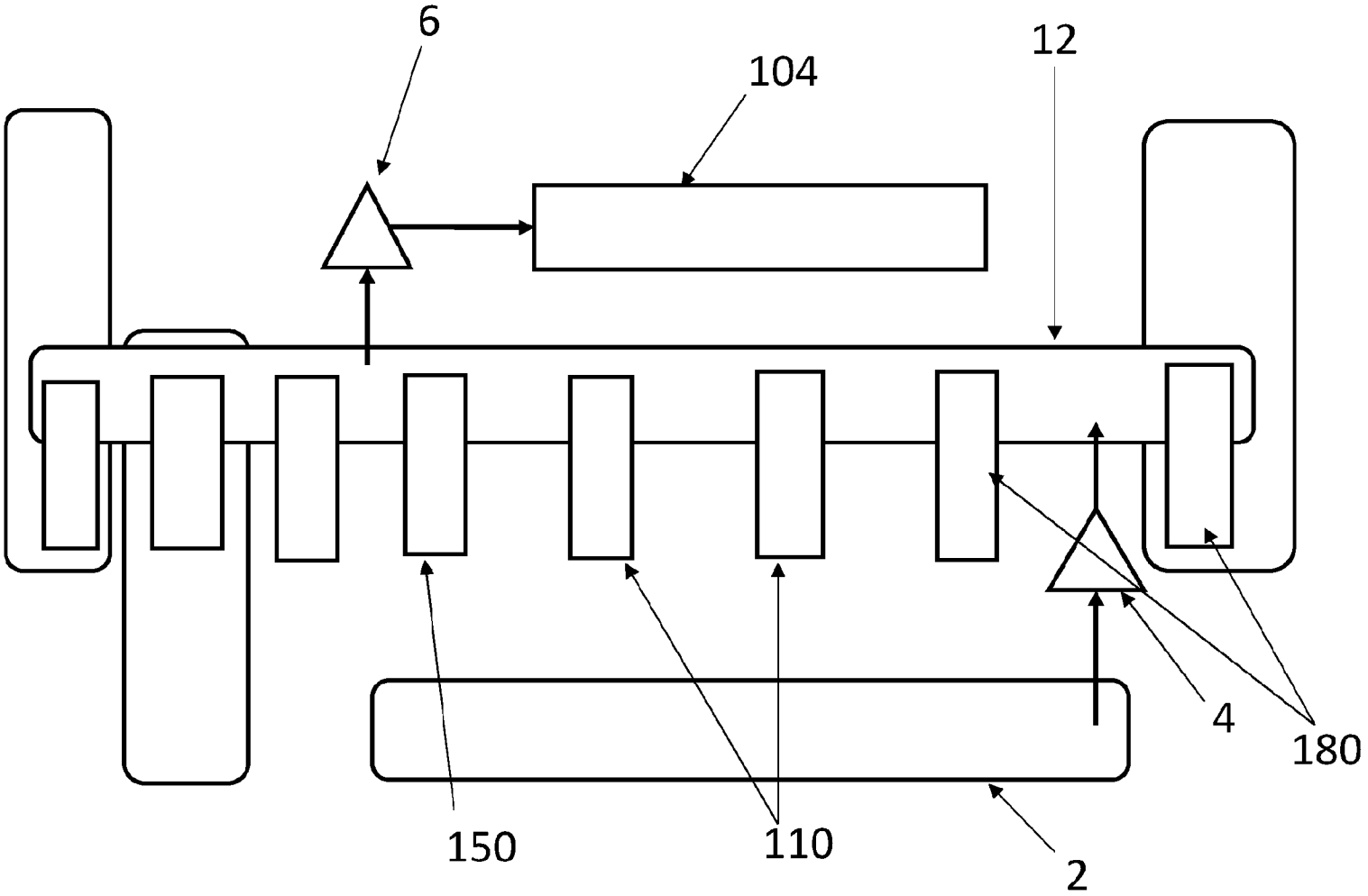
FIG. 12 is a schematic illustration of an engine according to a third embodiment of the disclosure.

Referring to FIG. 12, the engine 1 may further comprise a metering valve 6. The metering valve 6 may be configured to control the amount of lubricating substance delivered to the internal peripheral surface 104 of the engine housing 10 to provide lubrication to the contacting surfaces of the rotary piston 16 itself.

Figure 13:
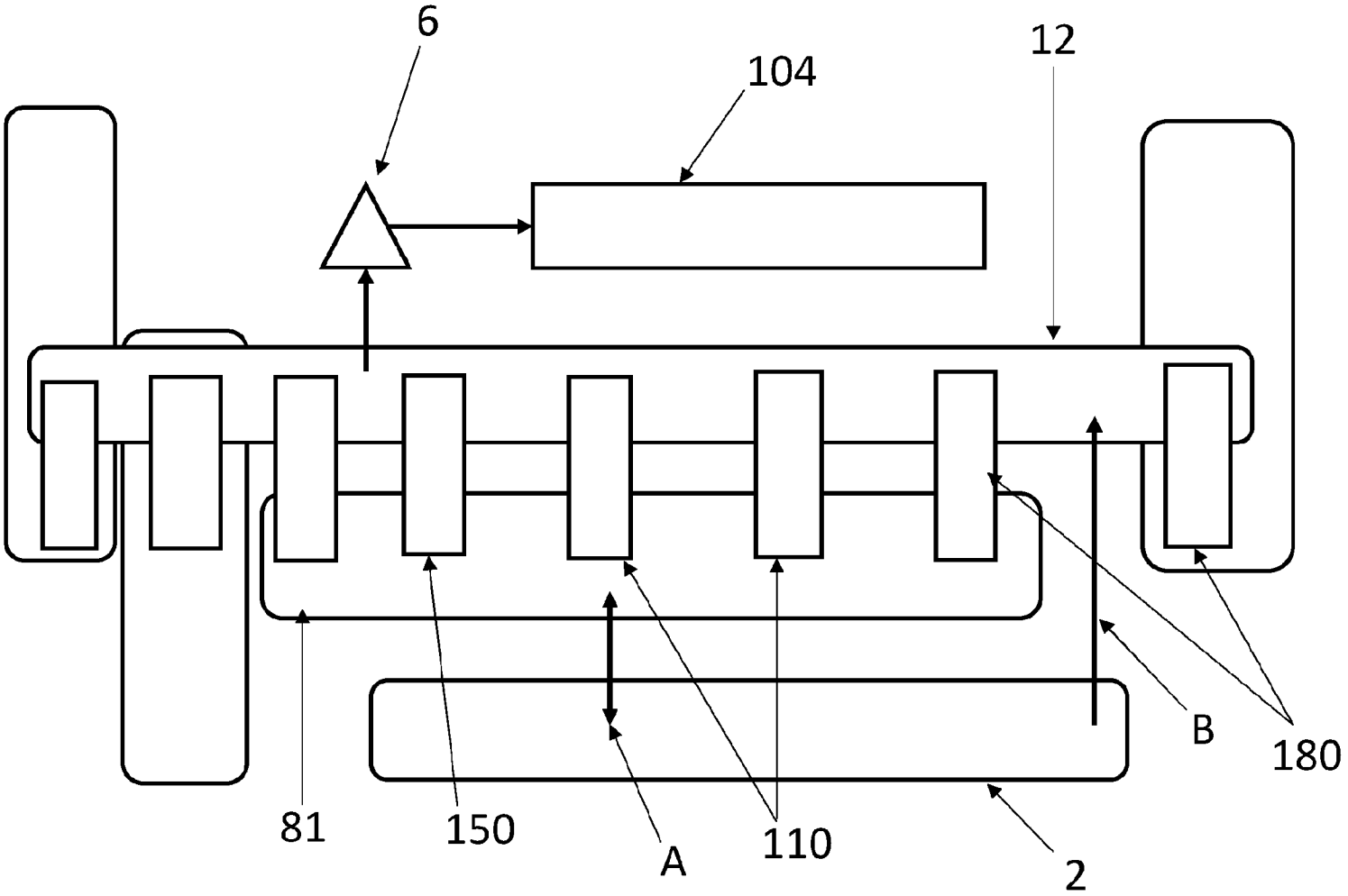
FIG. 13 is a schematic illustration of an engine according to a fourth embodiment of the disclosure.

Referring to FIG. 13, the engine 1 may further comprise a self-pressurising air rotor cooling system (SPARCS). The SPARCS may comprise a rotor cooling system cavity 81.

Figure 2:
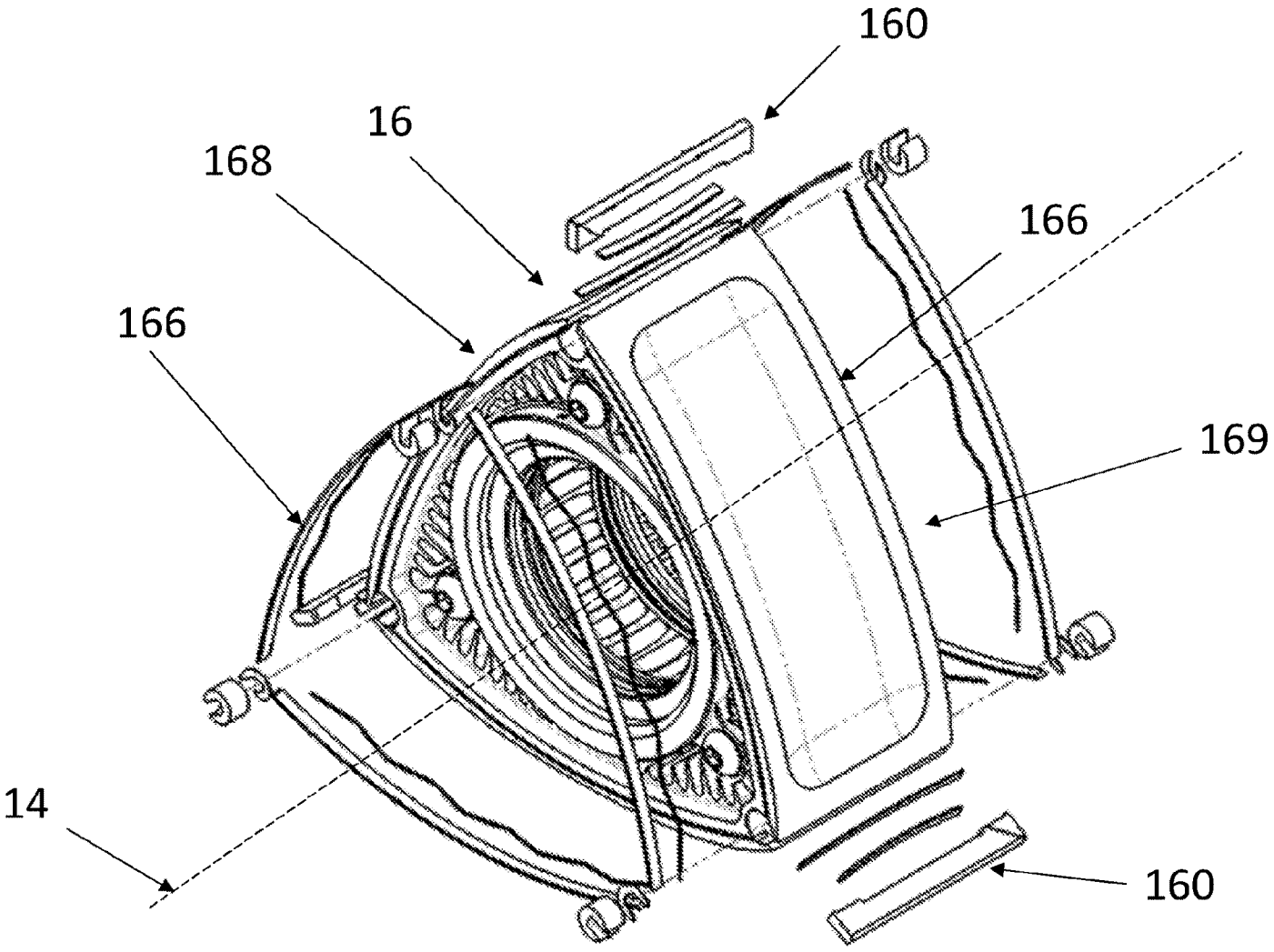
FIG. 2 is a perspective view of a rotary piston.

Referring to FIG. 2, the rotary piston 16 may have a first face 168 and a second face 169. The first face 168 and the second face 169 may be on opposing sides of the rotary piston 16. One or more side seals 166 may be positioned on the first face 168 and/or the second face 169. The side seal(s) 166 may be located between the apex seals 160.

Referring to FIGS. 1*a* and 1*b*, the combustion gases in the working chambers 106 may leak past the side seal(s) 166 to passages located in the rotary piston 16. These leaked combustion gases are referred to as blow-by gases. The blow-by gases may enter the rotor cooling system cavity 81 (FIG. 13) via the passages. Accordingly, the rotor cooling system cavity 81 may be pressurised. In such versions, the lubricating substance reservoir 2 may be pressurised by the blow-by gases in the rotor cooling system cavity 81 (indicated in FIG. 13 by a double headed arrow designated A). Accordingly, pure oil from the lubricating substance reservoir 2 may be forced to the first bearing 18 (indicated in FIG. 13 by arrow designated B) by the pressure acting on the lubricating substance reservoir 2. Thus, the pump 4 (shown on FIG. 12) may not be required.

A separate feed directly from the lubricating substance reservoir 2 to the internal peripheral surface 104 of the engine may be provided, although this is unlikely to be necessary because initial testing has shown that sufficient lubricating substance can reach all of the essential components of the engine via the internal path of the output shaft 12.

Referring to FIGS. 10*a* and 10*b*, the pump 4 pumps the lubricating substance from the lubricating substance reservoir 2 to the internal path 13 of the engine housing 10 via the first bearing 18. In one embodiment of the disclosure, the pump 4 is controlled by the Engine Control Unit (ECU). The sensors located in the engine 1 send relevant information (for example, oil level, pressure, temperature and flowrate) regarding the physical state of the engine 1 to the ECU. The relevant information may be sent at pre-determined intervals. The flowrate of the lubricating substance supplied to the first bearing 18 is then adjusted by the ECU based on the relevant information to compensate for any variance in the physical properties of the lubricating substance, for example, viscosity. For example, at higher temperatures, the viscosity of the lubricating substance inside the engine 1 is likely to decrease, therefore, lower flowrates are required to achieve sufficient lubrication. The ECU ensures optimum amount of lubricating substance is supplied to the engine, thus limiting wastage of the lubricating substance. In another embodiment of the disclosure, the pump 4 is manually controlled. The user can determine the amount of lubricating substance consumed in a time period by observing change in the lubricating substance level from the calibrated sight glass 20 on the lubricating substance reservoir 2. Alternatively, the sensors installed in the engine 1 provide the relevant information (for example, remaining volume of lubricating substance, pressure, temperature and flowrate) to the user via a user interface. Subsequently, the user can alter the flowrate of the lubricating substance accordingly by adjusting power of the pump 4.

In some embodiments, referring particularly to FIGS. 6 and 11, the lubricating substance is pumped to the inlet 108 of the engine housing 10. The lubricating substance then flows along the supply channel 1080 until it reaches the channel 1822 of the first bearing 18. The lubricating substance flows along the channel 1822 until it enters the inlet 1820. The lubricating substance then lubricates contact surfaces between the rolling elements 186 and the output shaft 12. As the output shaft 12 rotates, the rolling elements 186 also rotate in the same direction. The lubricating substance is further distributed between the contact surfaces. The axial vibration of the output shaft 12 is thus reduced by the first bearing 18, ensuring smooth rotation along the axis 14.

The first pair of seals 180 are provided to direct flow of the lubricating substance from the first bearing 18 to the first section 130 of the internal path 13 via the first part 1300. Similarly, the second pair of seals 110 are provided to direct flow of the lubricating substance from the second bearing 11 to the second section 132 of the internal path 13 via the first part 1320. The third seal 150 is also provided to direct flow the lubricating substance in the third bearing 15 to the inlet on the first side 1700 of the thrust bearing 17. In some embodiments, the third bearing 15 and the thrust bearing 17 are configured so that the lubricating substance is received by the thrust bearing 17 along a direction parallel to the axis 14. The lubricating substance then lubricates the thrust bearing 17 and exits from the outlet of the second side 1720 of the thrust bearing 17.

The following advantages of the engine 1 are apparent.

First, lubricating substance consumption by the engine 1 is significantly reduced when compared to the prior art. This is because lubricating substance is directed specifically to locations that require lubrication, i.e., the first 18, second 11 and third 15 bearings, and not to component parts that require little or no lubrication. This controlled feed of the lubricating substance into the engine 1 ensures minimum amount of wastage. Engines according to the present invention have been shown to consume oil at a rate of approximately 10 cc/hr, compared to approximately 150 cc/hr in the prior art. Accordingly, engines of the present disclosure have lower hydrocarbon emissions when compared to the prior art, and are therefore more environmentally friendly than prior art engines.

Second, the bearings receive pure oil or substantially pure oil due to the lubricating substance being delivered specifically to those locations first. The lubricating substance does not mix with impurities inside the engine 1, e.g. from the sliding surfaces of the rotary piston, before contacting the bearings. This can lead to an increase in the lifetime of these moving components.

Third, since a significantly smaller volume of lubricating substance is required, the overall size and/or weight of the vehicle or device can be reduced, e.g. by reducing the volume of the lubricating substance reservoir. This advantage is particularly beneficial where the engine is utilised in aircraft, such as unmanned aerial vehicles.

Fourth, having a controlled flow path for the lubricating substance simplifies the control measures that are required—there is only one inlet and outlet for the lubricating substance. These simplified control measures can result in more accurate controls being employed by the ECU, further increasing the reliability of the engine 1.

It will be readily appreciated by the skilled person that additional bearings may be provided that are configured to support and facilitate rotation of the output shaft 12. Furthermore, the engine 1 may comprise one or more additional rotary pistons 16. Such rotary pistons may comprise associated respective bearings, as would be appreciated by the skilled person.

Furthermore, whilst embodiments depicted in the figures show that the lubricating substance is delivered to the first bearing 18 from the lubricating substance reservoir 2, it will be appreciated by the skilled person that the lubricating substance could alternatively be delivered to any one of the other bearings, e.g. the second bearing 11 or the third bearing 15, without departing from the scope of the invention.

When used in this specification and claims, the terms "comprises" and "comprising" and variations thereof mean that the specified features, steps or integers are included. The terms are not to be interpreted to exclude the presence of other features, steps or components.

The invention may also broadly consist in the parts, elements, steps, examples and/or features referred to or indicated in the specification individually or collectively in any and all combinations of two or more said parts, elements, steps, examples and/or features. In particular, one or more features in any of the embodiments described herein may be combined with one or more features from any other embodiment(s) described herein.

Protection may be sought for any features disclosed in any one or more published documents referenced herein in combination with the present disclosure.

Although certain example embodiments of the invention have been described, the scope of the appended claims is not intended to be limited solely to these embodiments. The claims are to be construed literally, purposively, and/or to encompass equivalents.

The invention claimed is:

1. A rotary piston internal combustion engine including:

an engine housing;

an output shaft configured to rotate relative to the engine housing about an axis for transmitting power to parts to be operated;

a rotary piston mounted eccentrically on the output shaft;

a first bearing configured to support and facilitate rotation of the output shaft, the first bearing being sandwiched between a first pair of seals; and a second bearing configured to support and facilitate rotation of the rotary piston, the second bearing being sandwiched between a second pair of seals; and wherein the output shaft defines an internal path comprising a first section to allow a lubricating substance to flow between the first bearing and the second bearing in use, the internal path comprises a second section to allow the lubricating substance to flow between the second bearing and a third bearing in use, and the output shaft defines a bore which at least partially extends along the axis, the rotary piston internal combustion engine further comprising a first barrier member, the first barrier member being located in the bore between the first section and the second section, wherein the first barrier member is configured to direct flow of the lubricating substance from the first section into the second bearing.

2. The rotary piston internal combustion engine according to claim 1, wherein the first barrier member is configured to prevent flow of the lubricating substance along the bore and past the first barrier member.

3. The rotary piston internal combustion engine according to claim 1, further comprising a second barrier member, wherein the second barrier member is located in the bore and is configured to direct flow of the lubricating substance from the second section into the third bearing, preferably wherein the second barrier member is configured to prevent flow of the lubricating substance along the bore and past the second barrier member.

4. The rotary piston internal combustion engine according to claim 3, wherein the rod is biased towards the first bearing.

5. The rotary piston internal combustion engine according to claim 1, further comprising a rod located within the bore, preferably wherein the rod comprises one or both of the first barrier member and a second barrier member.

6. The rotary piston internal combustion engine according to claim 1, wherein the third bearing is configured to support and facilitate rotation of the output shaft.

7. The rotary piston internal combustion engine according to claim 1, wherein the third bearing is in fluid communication with a thrust bearing.

8. The rotary piston internal combustion engine according to claim 7, wherein the second bearing and the thrust bearing are configured so that, in use, the lubricating substance is received by the thrust bearing from the second bearing along a direction parallel to the axis.

9. The rotary piston internal combustion engine according to claim 7, the thrust bearing including a first side and a second side, the second side being spaced apart from the first side along the axis, wherein the first side includes an inlet for receiving the lubricating substance from the third bearing and the second side includes an outlet for the lubricating substance to exit the thrust bearing.

10. The rotary piston internal combustion engine according to claim 7, wherein the third bearing is sandwiched between the thrust bearing and a third seal.

11. The rotary piston internal combustion engine according to claim 1, wherein the first bearing and/or the third bearing, where present, includes:

a ring;

a retainer located within the ring and mounted coaxially relative thereto; and a rolling element, wherein the rolling element is held relative to the ring by the retainer.

12. The rotary piston internal combustion engine according to claim 11, wherein the retainer defines an aperture which extends from an outer surface to an inner surface thereof and wherein the aperture receives at least a part of the rolling element.

13. The rotary piston internal combustion engine according to claim 11, wherein the ring includes an inlet configured to receive the lubricating substance, preferably wherein the ring includes a channel which extends around an outer surface thereof, the channel being in fluid communication with the inlet, more preferably wherein the inlet is formed in the channel.

14. The rotary piston internal combustion engine according to claim 1, wherein the first and/or the second pair of seals includes one or more seals configured to withstand fluid pressures of 300 kPa and above.

15. The rotary piston internal combustion engine according to claim 1, wherein the second bearing comprises a ring fixed relative to an inner periphery of the rotary piston.

16. The rotary piston internal combustion engine according to claim 1 further comprising a lubricating substance reservoir and a pump, wherein the pump is configured to pump the lubricating substance from the lubricating substance reservoir to the first bearing.

17. The rotary piston internal combustion engine according to claim 1, further comprising a rotor cooling system cavity and a lubricating substance reservoir, wherein in use, the lubricating substance reservoir is pressurised by blow-by gases in the rotor cooling system cavity such that the lubricating substance flows to the first bearing from the lubricating substance reservoir.

18. A vehicle or a device comprising the rotary piston internal combustion engine according to claim 1.

19. The rotary piston internal combustion engine according to claim 1, wherein the first pair of seals includes a first seal configured to withstand fluid pressures of 300 kPa and above and a second seal configured to withstand fluid pressures of up to 299 kPa.

* * * * *